US006309365B1

(12) United States Patent
Lacey

(10) Patent No.: US 6,309,365 B1
(45) Date of Patent: Oct. 30, 2001

(54) HEAD MASSAGING DEVICE

(76) Inventor: Dwayne Lacey, 3 Oldham Crescent, Hilton Western Australia 6163 (AU)

( * ) Notice: Subject to any disclaimer, the term of this patent is extended or adjusted under 35 U.S.C. 154(b) by 0 days.

(21) Appl. No.: 09/335,714

(22) Filed: Jun. 18, 1999

(51) Int. Cl.[7] ..... A61H 7/00
(52) U.S. Cl. ..... 601/137; 601/136
(58) Field of Search ..... 601/136–138, 601/95, 97, 103, 107, 111–114, 166, 133–135; 606/202, 204.15, 119, 122; 4/515, 537; 294/55.5, 118, 33

(56) References Cited

U.S. PATENT DOCUMENTS

| | | | | |
|---|---|---|---|---|
| D. 382,971 | * | 8/1997 | Haldi | D24/211 |
| D. 384,157 | * | 9/1997 | Kusnets et al. | D24/211 |
| D. 385,632 | * | 10/1997 | Chen | D24/214 |
| 835,688 | * | 11/1906 | Read | 606/122 |
| 836,217 | * | 11/1906 | Rowe | 606/122 |
| 1,151,583 | * | 8/1915 | Hanson | 606/122 |
| 2,813,275 | * | 11/1957 | Davenport | 601/136 |
| 2,856,918 | * | 10/1958 | Kingery et al. | 601/153 |
| 4,162,675 | * | 7/1979 | Kawada | 601/112 |
| 5,728,050 | * | 3/1998 | Lin | 601/107 |

FOREIGN PATENT DOCUMENTS

| | | | | |
|---|---|---|---|---|
| 41606 | * | 3/1910 | (AT) | 601/107 |
| 134633 | | 8/1998 | (AU) . | |
| 334840 | * | 3/1921 | (DE) | 601/137 |
| 360209 | * | 9/1922 | (DE) | 601/137 |
| 70456 | * | 1/1933 | (FR) | 601/107 |
| 1093795 | * | 5/1955 | (FR) | 601/107 |
| 251075 | * | 4/1926 | (GB) | 601/137 |

* cited by examiner

*Primary Examiner*—Justine R. Yu
(74) *Attorney, Agent, or Firm*—Burr & Brown

(57) ABSTRACT

A head massaging device 10 comprises a plurality of resilient fingers 12 defining a head receiving space 14 having an opening 16 at one end formed by the relative juxtaposition of the respective free ends 18 of the fingers 12. The opening 16 is smaller than the size of the head so that in use when the device 10 is lowered onto the head so that the head enters the space 14 through the opening 16, the free ends 18 of the fingers 12 apply pressure to, and thus massage, the head. The massaging effect is enhanced by continuous raising, rotating and lowering of the device 10 on the head.

26 Claims, 1 Drawing Sheet

HEAD MASSAGING DEVICE

BACKGROUND OF THE INVENTION

Figure 1:
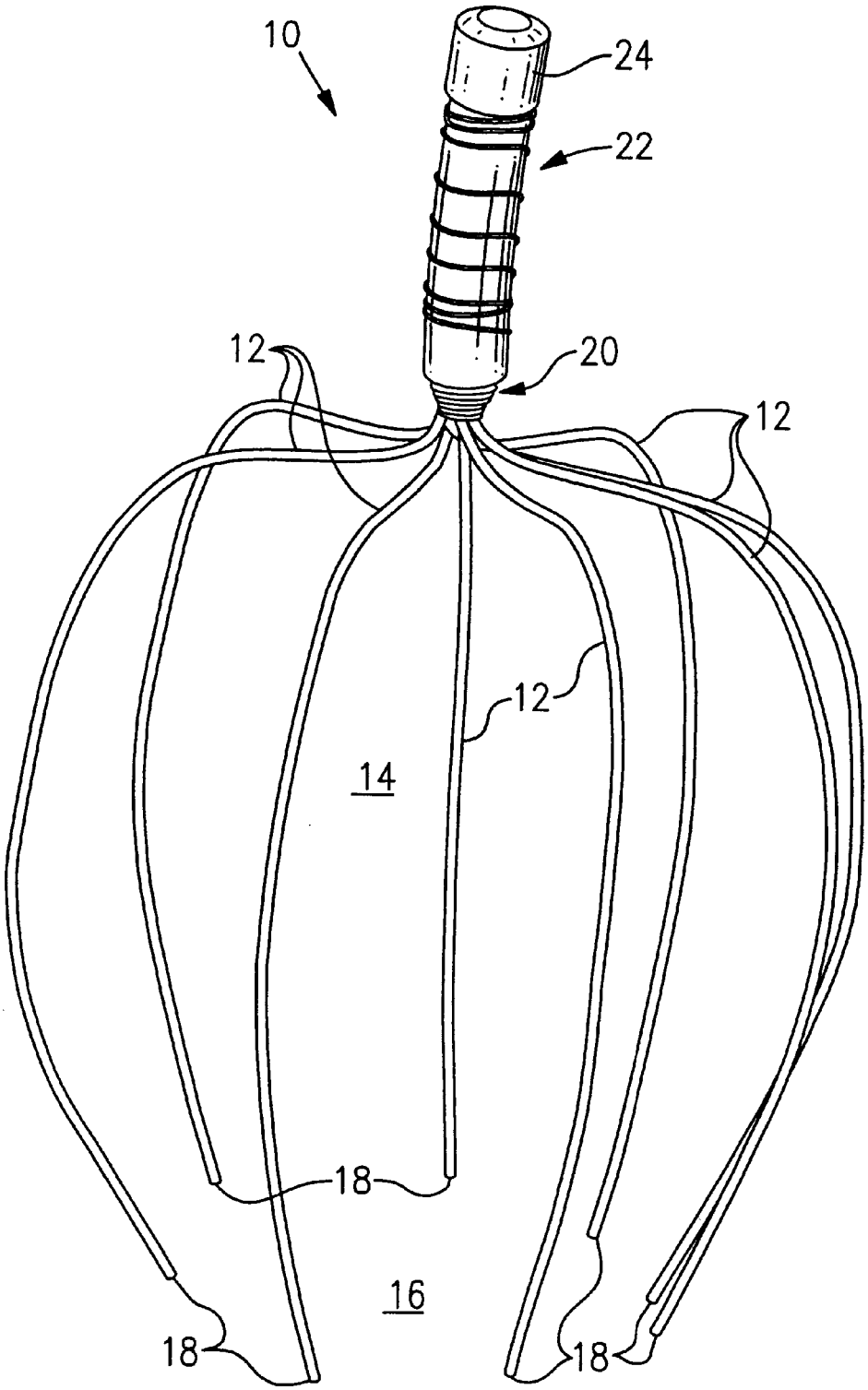

The present invention relates to a head massaging device.

Massaging of the human body is well known and is used to achieve numerous different effects. For example massaging may be used in physiotherapy for pain well established technique for relieving stress and tension and providing physical relaxation, stimulation and pleasure.

Massaging is predominantly performed by direction hand/finger manipulation although hand held massaging tools are also known. These tools can be broadly categorised into powered (eg electrically powered) and manual tools.

Of the manual massaging tools very few have been made specifically for massaging the head and scalp. One tool that is known comprises four small wooden spheres connected to a larger central and raised wooden sphere by short wooden rods. The largest sphere acts as a handle to push and rub the smaller spheres against the body. These spheres can be applied to the head to massage the head and scalp.

SUMMARY OF THE INVENTION

The present invention was devised to produce an alternate form of manual head/scalp massaging device.

According to the present invention there is provided a head massaging device comprising a plurality of resilient fingers defining a head receiving space having an opening at one end formed by the juxtaposition of respective free ends of the fingers, the opening being smaller than the head whereby, in use, when the device is lowered onto the head so that the head enters the space through the opening, the free ends of the fingers apply pressure to and thus massage the head.

Preferably the fingers are pliable to that the size and shape of the opening can be varied.

Preferably the free end of each finger is smoothly terminated.

Preferably each free end is terminated in a bulb or ball like structure.

Preferably the free end of each finger terminates in a resin bulb or ball like structure.

Preferably the fingers are made of wire.

Preferably the fingers are electrically conductive.

Preferably the ringers are made of copper wire.

Preferably the head massaging device comprises between four and twenty four fingers.

Preferably the opposite ends of the finger are connected together.

Preferably the connected opposite end of the fingers terminate in or otherwise form a handle for gripping and manipulating the massaging device.

BRIEF DESCRIPTION OF THE DRAWING FIGURE

The FIGURE is a perspective view of an embodiment according to the present invention.

DETAILED DESCRIPTION OF PREFERRED EMBODIMENTS

An embodiment of the present invention will now be described by reference to the FIGURE.

The head massaging device 10 comprises a plurality of resilient fingers 12 defining a head receiving space 14 having an opening 16 at one end formed by the relative juxtaposition of the respective free ends 18 of the fingers 12. The opening 16 smaller than the size of the bead so that in use when the device 10 is lowered onto the head so that the head enters the space through the opening 16, the free ends 18 of the fingers 12 apply pressure to, and thus massage, the head.

The fingers 12 are pliable so that the size and shape of the openings 16 can be varied to suit different people. That is, the fingers 12 can be bent to ensure that the opening 16 is of a size so that the free ends 18 contact the head/scalp of a person when the device 10 is lowered onto the head with the head entering the space 14 through opening 16.

The characteristics of resilience and pliability of the fingers 12 can be achieved by making the fingers 12 from wire. Copper wire is particularly well suited because of its wide availability and low cost. It may be beneficial for the wire making up the fingers 12 to be electrically conductive, which of course will follow if the wire is made from copper.

To ensure that the free ends 18 do not scratch the scalp, they are smoothly terminated. This can be achieved by terminating the free end of each finger in a bulb or ball like structure. This structure can be formed integrally with the fingers 12. Alternately, bulb or ball like structures can be fixed or otherwise attached to the free ends 18. One way of doing this is to dip the lower ends of the fingers 18 into a resin then lift the fingers 12 out of the resin so that as the resin flows down each of the fingers 12 it collects and forms a droplet depending from the free ends 18 which upon hardening forms the bulb or ball like structure.

Opposite ends 20 of the fingers 12 are connected together to form part of a handle 22 for gripping and manipulating the device 10. When the fingers 12 are made of wire, the free ends 20 are simply twisted and otherwise wound together. A plastic or other sheath 24 can be slipped over the free ends 20 to make the handle 22 easier to grip.

By making the fingers 12 pliable, the device 10 can be easily packaged and stored in a flat rectangular box by simply flattening half of the fingers 12 on opposite sides of the handle 22. When it is desired to use the device 10 the fingers 12 are simply spread out about the handle 22 from the flat condition.

Now that an embodiment of the massaging device 10 has been described in detail it will be apparent to those skilled in the relevant arts and numerous modifications and variations can be made without departing from the basic inventive concepts. For example, the embodiment illustrated depicts a device 10 having eight fingers 12. However the device 10 can be made with any number of fingers with the preferred minimum number being four and preferred maximum number being twenty four. Further, the fingers 12 may be made from plastics, synthetic materials or composites. It is also stressed that the pliability of the fingers 12 is not an essential characteristic of the device 10. If the fingers 10 are made solely from a plastics material then they will still have the resilient characteristic as required but not the preferred feature of pliability. In yet a further variation, each finger 12 can be made as a dual or multi component element having at least a first lower element which includes the free ends 18 being made from a resilient material and a second upper component that can provide the feature of pliability. For example, each finger 12 can be made from the first lower length of plastics material which includes the free end 18 and an upper length say of wire joined to the lower length (for example by an adhesive or epoxy resin) leading to the handle 22 to provide the characteristic of pliability to the finger 12. This then allows the finger 12 to be flattened for storage and opened up for use as well as allowing reshape and resizing of the opening 16. Also, there are numerous alternatives for smoothly terminating the free end 18 of each finger 12. For example, a plastic or metal sleeve having a smooth end can be applied and otherwise affixed to the free end 18 of each finger provided there is a smooth termination. Alternately, the free end 18 of each finger may simply be machined or otherwise worked to provide a smooth termination.

All such modifications and variations are deemed to be within the scope of the present invention the nature of which is to be determined from the above description and the appended claims.

What is claimed is:

1. A head massaging device consisting essentially of a plurality of resilient fingers defining a head receiving space for receiving a head, said fingers each having a free end, said head receiving space having an opening at one end formed by a juxtaposition of said free ends of said fingers, at least a portion of said head receiving space having a circumference which is greater than a circumference of said opening, said circumference of said opening being smaller than said head whereby, in use, when said device is lowered onto said head so that said head enters said head receiving space through said opening, said free ends of said fingers apply pressure to and thus massage said head.

2. The device according to claim 1 wherein said fingers are pliable so that the size and shape of said opening can be varied.

3. The device according to claim 2 wherein said free end of each finger is smoothly terminated.

4. The device according to claim 2, wherein said fingers comprise wire.

5. The device according to claim 2, wherein said fingers comprise copper wire.

6. The device according to claim 3 wherein each said free end is terminated in a bulb or ball structure.

7. The device according to claim 6, wherein said fingers are electrically conductive.

8. The device according to claim 3 wherein said fingers made of comprise wire.

9. The device according to claim 8 wherein said fingers are electrically conductive.

10. The device according to claim 3 wherein said fingers comprise copper wire.

11. The device according to claim 1 wherein said device comprises from four to twenty-four said fingers.

12. The device according to claim 1 wherein said fingers each further have an opposite end, said opposite ends of said fingers being connected together.

13. The device according to claim 12 wherein said connected opposite ends of said fingers terminate in or form a handle for gripping and manipulating said massaging device.

14. A head massaging device consisting essentially of a plurality of resilient and pliable fingers, said fingers each having a free end and an opposite end, said opposite ends being connected together, said fingers defining a self-supporting head-receiving space for receiving a head, said space extending between said free ends and said opposite ends and having a self-maintained opening at one end formed by a juxtaposition of said free ends of said fingers, said opening being of a circumference smaller than a circumference of said head, whereby said head can fit inside said space with said free ends in contact with said head, and at least a portion of said head-receiving space having a circumference which is greater than said circumference of said opening whereby, in use, when said device is lowered on to said head so that said head enters said head-receiving space through said opening, said free ends of said fingers apply pressure to and thus massage said head.

15. The device according to claim 14, wherein each said free end of each said finger is smoothly terminated.

16. The device according to claim 15, wherein each said free end is terminated in a bulb or ball-like structure.

17. The device according to claim 14, wherein said device comprises from four to twenty-four said fingers.

18. The device according to claim 14, wherein said connected opposite ends of said fingers terminate in or form a handle for gripping and manpulating said massaging device.

19. A head massaging device comprising a plurality of resilient fingers, said fingers each having a free end and an opposite end, said opposite ends being connected together and terminating in or forming a handle for gripping and manipulating said massaging device, each of said fingers having a transversely extending portion immediately adjacent the handle, each said transversely extending portion being followed by a contiguous portion extending downwardly and inwardly from said transversely extending portion, said continuous portion terminating in said free end, said transversely extending portion and contiguous portion of said fingers together defining a head-receiving space for receiving a head said space extending between said free ends and said opposite ends and having an opening at one end formed by a juxtaposition of said free ends of said fingers, said opening having a circumference smaller than a circumference of said head, and at least a portion of said head-receiving space having a circumference which exceeds said circumference of said opening whereby, in use, when said device is lowered on to said head so that said head enters said head-receiving space through said opening, said free ends of said fingers apply pressure to and thus massage said head.

20. The device according to claim 19, wherein said fingers are pliable so that the size and shape of said opening can be varied.

21. The device according to claim 19, wherein each said free end of each said finger is smoothly terminated.

22. The device according to claim 19, wherein each said free end is terminated in a bulb or ball-like structure.

23. The device according to claim 19, wherein said fingers comprise wire.

24. The device according to claim 23, wherein said fingers are electrically conductive.

25. The device according to claim 24, wherein said fingers comprise copper wire.

26. The device according to claim 19, wherein said device comprises from four to twenty-four said fingers.

* * * * *

UNITED STATES PATENT AND TRADEMARK OFFICE

CERTIFICATE OF CORRECTION

PATENT NO. : 6,309,365 B1
DATED : October 30, 2001
INVENTOR(S) : Dwayne Lacey

It is certified that error appears in the above-identified patent and that said Letters Patent is hereby corrected as shown below:

Column 1,
Line 8, after "pain", insert -- relief or to assist in the healing of damaged muscles or tendons. Massaging is also a --.
Line 47, change "ringers" to -- fingers --.
Line 50, change "finger" to -- fingers --.

Column 2,
Line 3, after "16", insert -- is --.
Line 3, change "bead" to -- head --.
Line 33, change "2" to -- 15 --.
Line 35, change "2" to -- 15 --.
Line 39, change "6" to -- 4 --.
Line 42, delete "made of".

Column 4,
Line 31, change "continuous" to -- contiguous --.
Line 34, after "head", insert -- , --.
Line 51, change "19" to -- 21 --.

Signed and Sealed this

Second Day of July, 2002

*Attest:*

*Attesting Officer*

JAMES E. ROGAN
*Director of the United States Patent and Trademark Office*

US006309365C1

(12) EX PARTE REEXAMINATION CERTIFICATE (5937th)

United States Patent

Lacey

(10) Number: US 6,309,365 C1

(45) Certificate Issued: Oct. 9, 2007

(54) HEAD MASSAGING DEVICE

(76) Inventor: Dwayne Lacey, 3 Oldham Crescent, Hilton Western Australia 6163 (AU)

Reexamination Request:
No. 90/007,094, Jun. 19, 2004

Reexamination Certificate for:

| | |
|---|---|
| Patent No.: | **6,309,365** |
| Issued: | **Oct. 30, 2001** |
| Appl. No.: | **09/335,714** |
| Filed: | **Jun. 18, 1999** |

Certificate of Correction issued Jul. 2, 2002.

(51) Int. Cl.
*A61H 7/00* (2006.01)

(52) U.S. Cl. ..... 601/137; 601/136

(58) Field of Classification Search ..... 2/171.2, 2/182.2, 182.6, 204.13; 601/128–129, 110, 601/98; 606/124, 201, 206, 210; D24/214–15; 132/273–75, 263; 294/99.2; D7/696
See application file for complete search history.

(56) References Cited

U.S. PATENT DOCUMENTS

| | | | | | |
|---|---|---|---|---|---|
| D35,313 | S | * | 11/1901 | Wirt | D24/211 |
| 2,113,444 | A | | 4/1938 | Erikson | |
| 2,427,610 | A | | 9/1947 | Konig | |
| 2,633,844 | A | * | 4/1953 | Herndon | 601/128 |
| 2,664,884 | A | * | 1/1954 | La Verne | 601/135 |
| 2,959,167 | A | * | 11/1960 | Leclabart | 601/133 |
| 4,343,303 | A | | 8/1982 | Williams | |
| 4,722,111 | A | * | 2/1988 | Brodey et al. | 15/207.2 |
| 5,421,799 | A | | 6/1995 | Rabin | |
| 5,572,746 | A | * | 11/1996 | Linico | 2/182.1 |
| 5,611,771 | A | | 3/1997 | Taylor | |
| 6,315,743 | B1 | * | 11/2001 | Guest | 601/134 |
| D468,435 | S | * | 1/2003 | Qi et al. | D24/214 |
| D473,949 | S | * | 4/2003 | Sorlie et al. | D24/214 |
| D477,406 | S | * | 7/2003 | Schroer | D24/143 |
| D488,231 | S | * | 4/2004 | Sorlie | D24/214 |
| D488,561 | S | * | 4/2004 | Robbins et al. | D24/214 |
| 2002/0049400 | A1 | * | 4/2002 | Lacey | 601/137 |
| 2003/0149282 | A1 | * | 8/2003 | Kiyooka et al. | 549/346 |
| 2003/0208144 | A1 | * | 11/2003 | Sorlie et al. | 601/137 |
| 2005/0043656 | A1 | * | 2/2005 | Lacey | 601/72 |

FOREIGN PATENT DOCUMENTS

| | | |
|---|---|---|
| AU | S-134633 | 8/1998 |
| GB | 2167667 | 6/1986 |
| WO | WO 9707767 A1 * | 3/1997 |
| WO | 01/08628 | 2/2001 |

OTHER PUBLICATIONS

BPAI decision of Jun. 30, 2006 in 09/935297.*

* cited by examiner

*Primary Examiner*—Jeffrey R. Jastrzab

(57) ABSTRACT

A head massaging device 10 comprises a plurality of resilient fingers 12 defining a head receiving space 14 having an opening 16 at one end formed by the relative juxtaposition of the respective free ends 18 of the fingers 12. The opening 16 is smaller than the size of the head so that in use when the device 10 is lowered onto the head so that the head enters the space 14 through the opening 16, the free ends 18 of the fingers 12 apply pressure to, and thus massage, the head. The massaging effect is enhanced by continuous raising, rotating and lowering of the device 10 on the head.

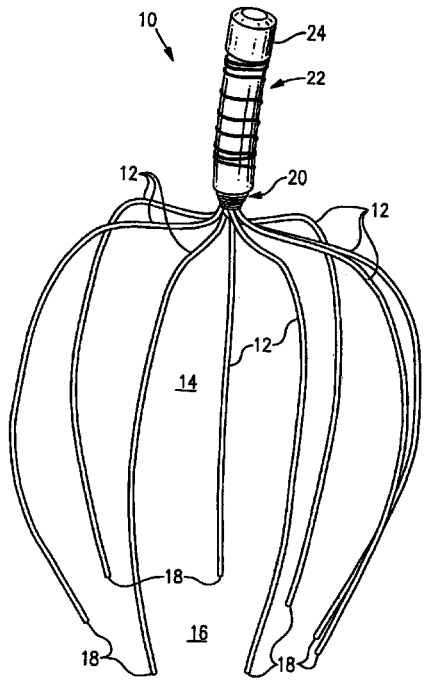

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–26 are cancelled.

* * * * *